US005552768A

United States Patent [19]

Mikiel et al.

[11] Patent Number: 5,552,768

[45] Date of Patent: Sep. 3, 1996

[54] PORTABLE WINDOW WEDGE WITH ALARM

[76] Inventors: Andrew Mikiel, 1142 Manhattan Ave. #151, Manhattan Beach, Calif. 90266; Karen Usevitch, 3454 Camden Ct., Palmdale, Calif. 93551-3552

[21] Appl. No.: 347,649

[22] Filed: Nov. 30, 1994

[51] Int. Cl.[6] ..... G08B 13/08

[52] U.S. Cl. ..... 340/546; 200/61.93; 292/343; 292/DIG. 20; 292/DIG. 28

[58] Field of Search ..... 340/546; 292/343, 292/339, DIG. 20, DIG. 28; 200/61.93

[56] References Cited

U.S. PATENT DOCUMENTS

| | | | |
|---|---|---|---|
| D. 173,487 | 11/1954 | Hines | D8/402 |
| D. 309,708 | 8/1990 | Rosa et al. | D8/402 |
| D. 333,424 | 2/1993 | Kramer | D8/402 |
| 1,695,872 | 12/1928 | White, Jr. | 292/DIG. 28 |
| 2,472,216 | 6/1949 | Kasik | 292/343 |
| 4,890,092 | 12/1989 | Grimm | 340/546 |
| 5,392,026 | 2/1995 | Marik | 340/546 |

*Primary Examiner*—Glen Swann
*Attorney, Agent, or Firm*—David O'Reilly

[57] ABSTRACT

A portable sliding window lock consists of a molded resilient triangular block having a suction cup securely fastened to its base. The suction cup is fastened to the base so that a jamming tapered tip on the triangular block is angled slightly toward the mounting surface. The portable sliding window lock is mounted on the vertical surface of a flat window pane adjacent the frame of a sliding window to intercept and jam the window frame with the sliding window partially open. This prevents forcing the partially open window any further open to gain access to an area. An optional feature includes an audible alarm mounted on the resilient triangular block which is set-off by a switch activated by force applied to a sliding glass window engaging the resilient triangular block. The audible alarm is activated by a contact switch, motion sensing switch or pressure switch embedded in the molded resilient triangular block.

10 Claims, 2 Drawing Sheets

PORTABLE WINDOW WEDGE WITH ALARM

BACKGROUND OF THE INVENTION

1. Field of the Invention

This invention relates to security devices and more particularly, relates to a portable device for locking the position of a sliding window and the like.

2. Background Information

Every day people are victimized by criminals that gain entry through sliding glass windows and doors. Most sliding doors have locks, as do most sliding windows. However, some sliding windows do not lock and few, if any, provide for a lock in a partially opened position. Often a person would like to have a sliding window partially open to have air circulate, but this can sometimes be dangerous.

People have been victimized by criminals who have gained access through sliding glass windows that were partially opened. A criminal can simply push the window open and climb in to gain access to an area. For example, a substantial number of trains, and particularly those in Europe, have compartments with sliding glass doors and windows. Since train conductors must gain access to these compartments they are not provided with any type of locks. Travelers have been victimized by criminals gaining access through these entry points.

In recent years a family was attacked, and one family member murdered when the criminals gained access through an open sliding window. In another case, a baby was kidnapped while sleeping in its crib by a criminal gaining access through a sliding glass window. In areas such as those in trains, travelers are particularly vulnerable because no locks are provided. Apparently the belief is that it is unlikely that a criminal will gain access through a window of a train since windows are high and the train is moving. However, criminals have gained access at times, when a train makes a stop at a train station.

Devices to lock sliding doors and windows in the open position come in a variety of designs. One such device attaches to the door and has a pin that fits a socket. However, this requires a modification of the door and window and is a permanent installation. Few, if any, doors and windows are provided with such locks, and it does not help a person in a temporary location such as a train or hotel. A rod, stick or shaft can sometimes be placed in the track of the window to prevent the window from opening, but such a device is inconvenient to keep and use. It certainly does not help a person who is at a temporary location.

It is therefore one object of the present invention to provide a simple, easy to use device that can lock a sliding glass window and the like in a partially open position.

Still another object of the present invention is to provide a resilient triangular-shaped device that can be fastened to a vertical surface to lock a sliding window.

Yet another object of the present invention is to provide a portable window locking device comprised of a resilient triangular device having a built-in suction cup for mounting the device on a flat window surface to intercept a sliding glass window to prevent its opening.

Still another object of the present invention is to provide a portable window locking device having a built-in audible alarm.

Yet another object of the present invention is to provide a portable window locking device having an audible alarm mounted on a surface, and including molded electric contacts that activate the alarm when attempts are made to force a sliding window or door open.

BRIEF DESCRIPTION OF THE INVENTION

The purpose of the present invention is to provide a portable sliding window locking device that is easy to transport and use.

The portable locking device, for sliding windows and the like, solves the problems of unauthorized access by providing a resilient triangular wedge-like device that provides a barrier when mounted on the window, between the fixed window and the sliding window frame. The device includes a resilient suction cup for securely mounting the device on a vertical glass surface. The device is mounted by pressing the suction cup, which may be pre-moistened to improve adherence, to the surface of a window adjacent to the frame of the open window. The frame of the window will then abut an oblique surface of the portable sliding window lock "jamming it" between the frame and the surface of the glass. Any attempt by an intruder to force the window open, only "jams" the sliding window lock more tightly against the surface of the glass.

The sliding window lock is extremely light in weight and is very portable. A large mushroom-shaped suction cup is embedded in the base of its triangular design. The suction cup is provided with a small tab on one edge allowing the device to be easily and quickly removed in an emergency. A quick pull on the small tab releases the vacuum between the suction cup allowing it to be easily dislodged. Also, preferably, the suction cup is embedded in the base of the resilient triangular sliding window lock as far back from the jamming edge as possible.

The suction cup is preferably mounted at a slight angle to the jamming edge of the resilient triangular locking device so that it will sit level against the window surface without air gaps and also tilt the narrow jamming edge of the lock toward the surface. This helps to ensure the suction cup is sealed tightly and the jamming edge will slide under the frame of the sliding glass window. Preferably, the resilient triangular locking device is formed of a molded polyurethane elastomer with a boss or knob on the suction cup embedded in the elastomer material during molding.

A unique feature of the device is its resilient triangular design and construction of the polyurethane elastomer which allows it to be made in various colors to suit all tastes. It can be made clear as well as in attractive neon colors. The bright neon colors can also help make it clearly visible as a warning to a would-be criminal. It can also be made of a wood tone to match wooden window frames. The polyurethane elastomer construction provides resilience and flexibility that cushions the sliding frame and jams the device tighter against the window surface if attempts are made to force the window open.

Since most sliding glass windows and sliding doors on trains and the like do not provide locks, particularly when the window is partially opened, a person can feel comfortable and safe with this device in use. It can be used on many different sizes of windows. It can be applied high, low or centrally located on a window surface. Wherever it is applied to a surface of a window and securely attached with the suction cup, it is the position where the window frame will stop. It sets the window opening position allowing the window to be left slightly ajar for air circulation or allowing a pet to exit at night without the window being open any wider than the user desires.

Its unique design and portability allow many and varied uses of the portable sliding window lock. Travelers can use it to secure hotel room windows, recreational vehicle (RV) owners can use it for extra security of their windows, train travelers can use it to secure sliding windows and doors in compartments. These are just a few of the possible uses. It can also be made wider and longer for large windows or sliding doors.

An optional, but preferred embodiment of the invention, is to include an audible alarm in the device to detect and alert an occupant when an intruder is trying to force open the window. In this embodiment, a battery-powered audible alarm is securely attached to a rear surface of the triangular sliding glass window lock. The audible alarm, which can be a whistle, siren or any other type of audible alarm, is activated by a switch molded into the jamming surface of the sliding window lock. Preferably, a pair of electrical contacts are molded into the jamming surface near the narrow jamming tip of the triangular sliding glass window locking device.

Positioning of the molded electric contacts can vary. The farther back they are from the jamming tip reduces the potential for accidental activation by slight movement of the window frame. However, they should be placed sufficiently forward and toward the jamming tip to be activated when any substantial force is applied to the sliding glass window. Mounting the mold and electric contacts approximately in the center of the oblique jamming surface of the sliding glass window lock appears to be the best option.

When mounted on a window, in abutment with the frame of the sliding portion of the window, the electrical contacts will be slightly separated from the edge of the frame. Force applied by an intruder to open the window, will cause the window frame to ride-up on the oblique jamming surface activating the molded electric contacts and setting off the audible alarm. This alerts the homeowner or occupant of an attempt to force the sliding glass window open.

Another option is to include a motion sensing switch embedded in the resilient polyurethane elastomer triangular-shaped block. The motion sensing device is activated whenever an attempt is made to force open a sliding glass window causing the locking device to move. The motion causes the contacts to activate the audible alarm. Another option is to substitute a pressure sensitive switch for the motion sensor.

The above and other novel features and advantages of the invention will be more fully understood from the following detailed description and the accompanying drawings in which:

DETAILED DESCRIPTION OF THE INVENTION

Figure 1:
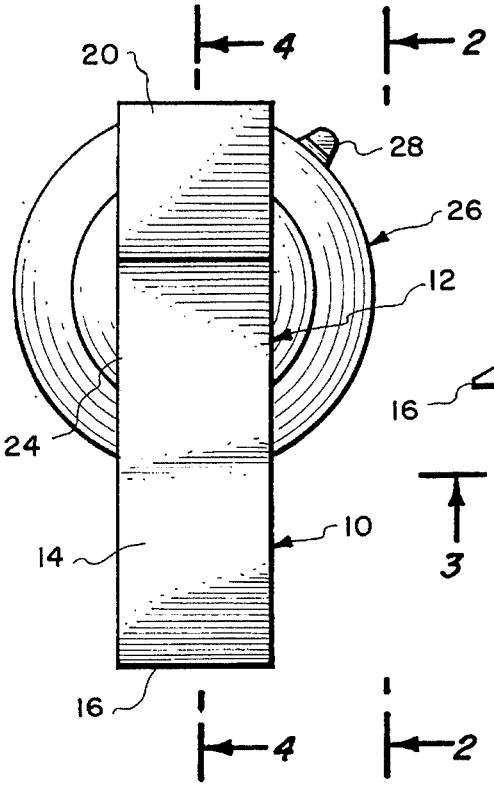
FIG. 1 is top view of a portable sliding window lock according to the invention.
Figure 2:
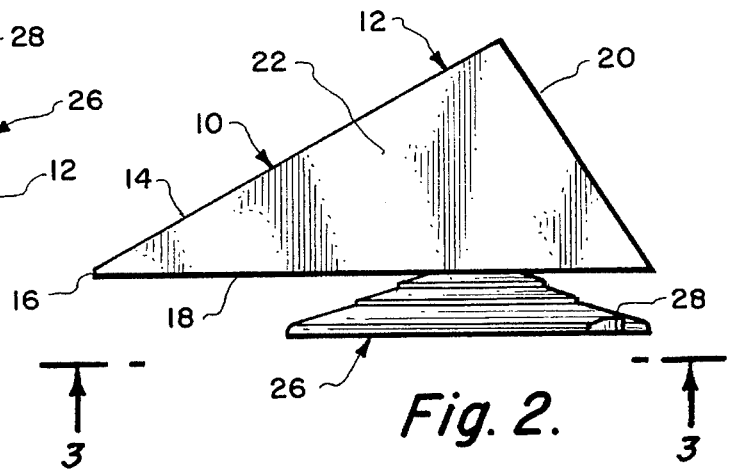
FIG. 2 is a side view taken at 2—2 of FIG. 1.
Figure 3:
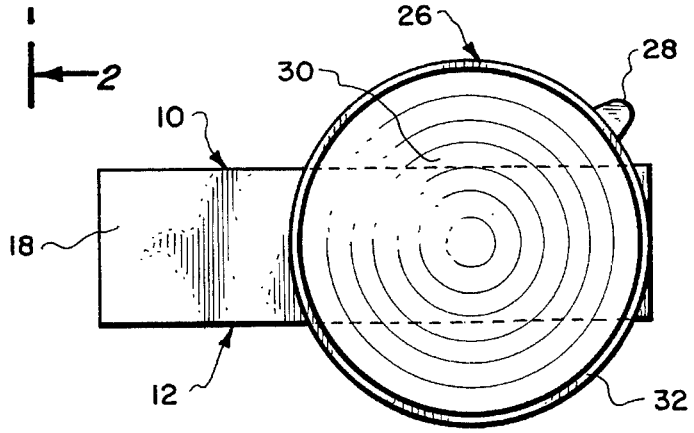
FIG. 3 is a bottom view taken at 3—3 of FIG. 2.

A sliding window locking device 10 is generally shown in FIGS. 1 through 3. The portable sliding glass window lock is comprised of resilient triangular block 12 having an oblique jamming surface 14 tapering to a jamming point 16. Preferably, resilient lock 10 is constructed of a soft flexible, but durable, plastic material such as a polyurethane elastomer.

Jamming surface 14 extends at an oblique angle from jamming tip 16. The resilient triangular block 12 has a horizontal surface 18 and a rear surface 20. Rear surface 20 can be at any convenient angle or even vertical. Horizontal surface 18 and oblique surface 14 taper toward jamming tip 16. Also, resilient triangular block 12 preferably has flat sides 22 and 24 and is preferably about one inch (1") wide.

To use the resilient triangular block 12, some means must be provided for securely fastening it to a vertical surface where it will not become easily dislodged. To accomplish this, a suction cup 26 is fastened to horizontal surface 18. Suction cup 26 includes a release tab 28 for quickly removing the portable sliding door lock whenever necessary. For example, in emergencies, a quick pull on release tab 28 will break the vacuum of suction cup 26 on a vertical surface allowing the sliding glass door lock 10 to be easily removed. Preferably, suction cup 26 is made of a very flexible plastic and has a large concave cavity 30 inside peripheral gripping edge 32 to assure a firm grip on a smooth vertical surface.

Figure 4:
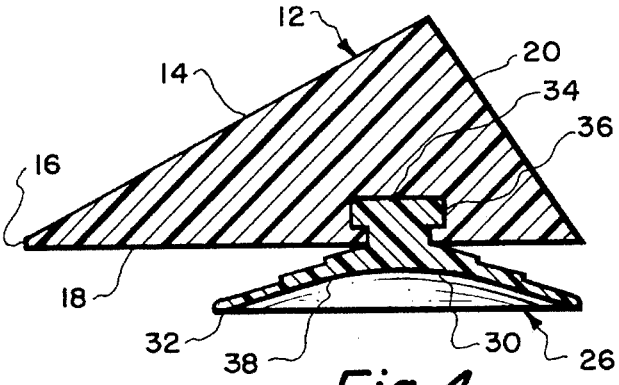
FIG. 4 is a sectional view illustrating the mounting of the suction cup on the triangular sliding glass locking device.

Suction cup 26 is securely attached to resilient polyurethane elastomer triangular block 12 as illustrated in the sectional view of FIG. 4. It should be noted that resilient polyurethane elastomer triangular block 12 has horizontal surface 18 and oblique surface 14 forming jamming tip 16, but rear surface 20 can at any angle or even vertical if desired.

Suction cup 26 is attached to resilient triangular block 12 when the block is molded of the polyurethane plastic. Suction cup 26 has post or knob 34 that is embedded in socket 36 in resilient triangular block 12 when it is molded. An undercut annulus 38 beneath boss or knob 34 allows the polyurethane elastomer to flow around knob 34 securely fastening it to triangular block 12 so that is may not easily come off.

Figure 5:
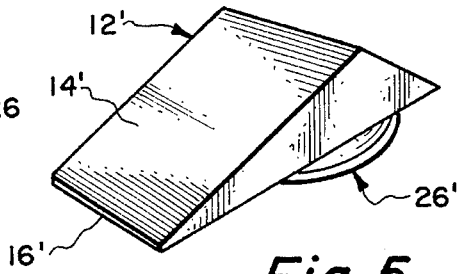
FIG. 5 is a perspective view of an optional design for the portable sliding window lock.

An optional embodiment is shown in FIG. 5 in which resilient triangular block 12' is formed with a relatively wide oblique surface 14' combining a wide jamming tip 16' that is suitable for large windows or sliding glass doors. The width can be several inches rather than the one inch of the preferred embodiments. In this embodiment a larger diameter suction cup 26' will be provided.

An optional, but preferred feature of the invention, is to mount resilient triangular block 26 at a slightly tilted or downward angle to suction cup 26. A downward angle of 5 to 10 degrees from horizontal (i.e., 95 to 100 degrees to the axis of suction cup post 34 is sufficient). This helps assure the suction cup will seal tightly against a flat window surface with a jamming tip angled downward and close to the window surface to increase the reliability that a sliding window frame will catch oblique surface 14 of resilient triangular block 12.

Figure 6:
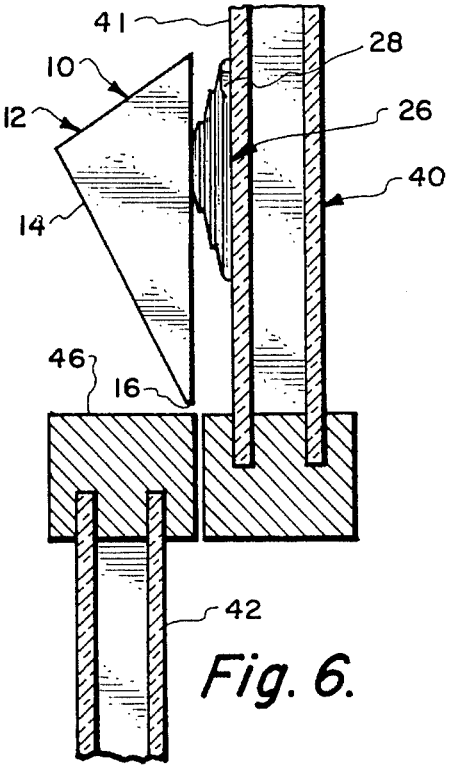
FIG. 6 is a partial sectional view illustrating the portable sliding window lock mounted on a window pane.
Figure 7:
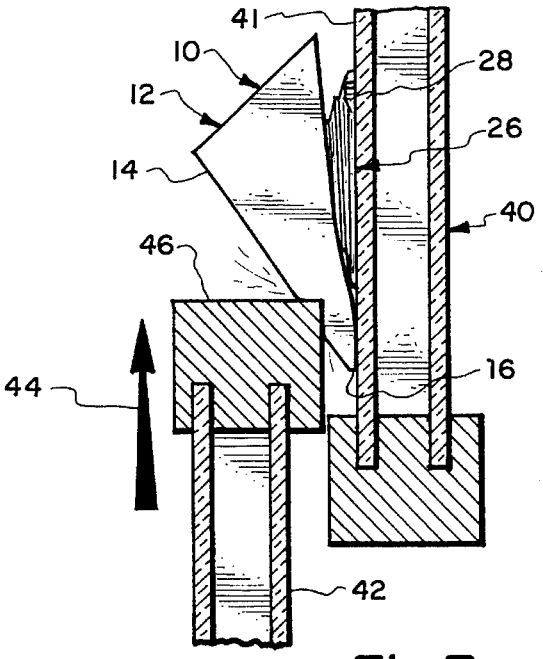
FIG. 7 is a partial sectional view of a sliding glass window illustrating the manner in which the portable sliding glass window lock prevents the sliding window from being forced open.

Mounting of portable sliding window lock 10 and its operation is illustrated in FIGS. 6 and 7. The window illustrated is the common double-pane type found in most homes. Portable sliding glass window 10 is positioned on the flat surface of fixed window 40 and pressed firmly to compress suction cup 26 creating a vacuum to securely adhere to the surface of window 40. It can help to slightly moisten suction cup 26 to assure the integrity of the seal. Portable sliding window lock 10 can be positioned anywhere on the surface of fixed window 40 depending upon how far the user desires sliding window 42 to open. It can also be mounted at the top, bottom or center with the latter probably being best.

The portable sliding window lock 10 can be used on vertical or horizontal windows. Vertical sliding windows are illustrated in FIGS. 6 and 7 such as those found in most homes, RV's or train windows. Generally sliding windows have a double-pane fixed window 40 and lower sliding window 42. Sliding window 42 is opened by raising it as illustrated in FIG. 7. Once sliding window 42 is opened it can be easily opened further from the outside by simply pushing the window up as illustrated by arrow 44. Thus, an intruder can easily gain access by raising sliding window 42 and climbing through the opening. There have been frequent reports of such access being gained on commuter trains in Europe. Travelers have often lost their possessing and had their lives threatened by intruders. However, this can be quickly, easily and effectively prevented with portable sliding window lock 10.

Once portable sliding window lock 10 is securely fastened to surface 41 on fixed window 40, it will further prevent opening of sliding glass window 42 as illustrated in FIG. 7. The user can set the open position of sliding glass window 42 by opening the window until frame 46 abuts oblique surface 14 on sliding glass window lock 10. Tapered jamming tip 16 passes beneath frame 46 because it is constructed to tilt downward slightly (about 5 to 10 degrees) to assure it will pass beneath frame 46. Once sliding window lock 10 is securely fastened to surface 41 of fixed window 40, sliding glass window 42 is opened until frame 46 abuts oblique surface 14. This fixes the open position of sliding glass window 42.

Any attempt to force sliding glass window open has the effect of jamming frame 46 against oblique surface 44 crushing resilient triangular block 12 against fixed window 40. A unique feature of the invention is that the resilient triangular block 12 having oblique surface 14 and suction cup 26 becomes more secure the greater the force applied to sliding window 42. This is because frame 46 tends to slide up oblique surface 14 effectively applying greater force normal to surface 41 of fixed window 40. Thus, portable sliding window lock 10 becomes more secure as an opening force is applied to sliding window 42 as indicated by arrow 44.

Figure 8:
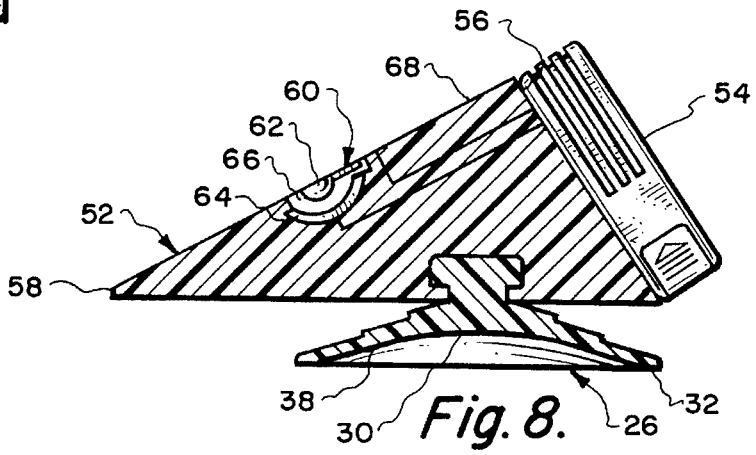
FIG. 8 is a sectional side view illustrating the portable sliding window locking device with an audible alarm.
Figure 9:
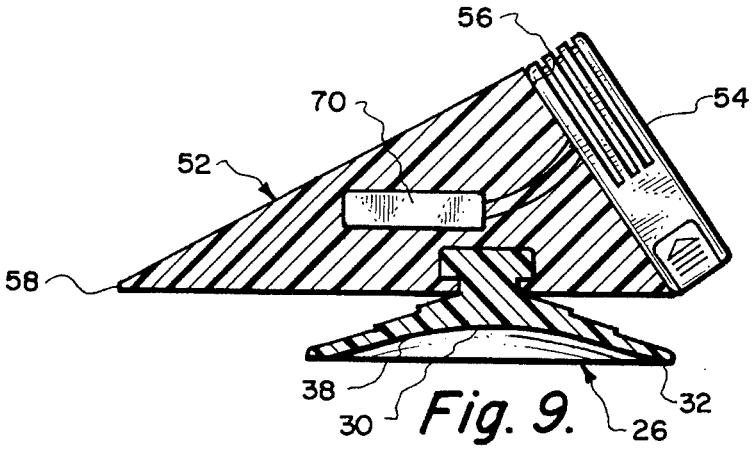
FIG. 9 is a sectional side view of an alternate embodiment of the portable sliding window locking device with an audible alarm shown in FIG. 8.

As an optional embodiment, an audible alarm may be included as illustrated in the sectional view of FIGS. 8 and 9. In this embodiment, resilient triangular block 52 has a suction cup 26 embedded in the resilient material as before. However, to provide an alarm to alert an occupant to an attempted break-in, an audible alarm 54 is secured to rear surface 56 of resilient triangular block 52. Audible alarm 54 is a battery-operated siren-type alarm that can be of any suitable design. It is mounted on surface 56 opposite jamming tip 58 end to prevent damage from contact with the window frame. It might also be embedded in surface 56 of resilient triangular block 12 if desired.

Audible alarm 54 is activated by switch 60 embedded in resilient triangular block 52. Switch 60 is comprised of a pair of contacts 62 and 64 embedded in oblique surface 68 and resilient triangular block 52. Contact 64 can be a coating in cavity 66 in resilient triangular block 52 with contact 62 being comprised of a conductive button mounted on a flexible arm. Preferably, switch 60 is mounted in the approximate center of oblique surface 68 on resilient block 52 where it will not normally be contacted by a frame of a sliding window such as frame 46 on sliding window 42 as shown in FIGS. 6 and 7. This prevents accidental activation of audible alarm 54 when installing the portable sliding window lock.

When portable sliding window lock, with audible alarm 54, is installed on a fixed window such as window 40 shown in FIG. 7, frame 46 of sliding window 42 will compress switch 60 by sliding up oblique surface 68 when excessive force is applied to the window to try and force it open. This will close switch 60 activating audible alarm alerting an occupant of an attempted break-in. It will also probably frighten and scare away the potential intruder.

Another option for the audible alarm portable sliding window locking device, is to provide a motion sensing device to activate audible alarm 54 as shown in FIG. 9. In this embodiment, a motion sensing device 70 is embedded in resilient triangular block 52 and connected to audible alarm 54. Once the portable sliding window lock with an audible alarm is installed, it will be activated by any attempts to open the sliding window causing the portable sliding window lock to move. Optionally, sensing device 70 could be a pressure switch that senses the pressure of the sliding glass window frame being forced against oblique surface 68.

Thus, there has been disclosed, a unique portable sliding window locking device that is safe and easy to use. It can be easily transported and quickly installed on a vertical window surface to hold a sliding glass window in a partially opened position selected by the user. It effectively locks sliding glass windows against being forced open when they are ajar preventing unauthorized access by intruders. In an optional embodiments an audible alarm is provided that is activated when any attempts are made to open a sliding glass window.

This invention is not to be limited by the embodiment shown in the drawings and described in the description which is given by way of example and not of limitation, but only in accordance with the scope of the appended claims.

What is claimed is:

1. A portable device for locking sliding windows and the like comprising;

a resilient triangular block having a horizontal surface and an oblique surface tapering to a jamming tip;

temporary fastening means integrally mounted on said horizontal surface for mounting said resilient triangular block on a vertical planar glass surface to allow mounting and removal quickly and easily;

said temporary fastening means comprising a suction cup secured to said horizontal surface of said resilient triangular block, said suction cup being mounted with said jamming tip tilted slightly toward said suction cup to assure said jamming tip intercepts the frame of a sliding window when installed;

whereby said resilient triangular block can be mounted on the surface of a sliding glass window to intercept the frame and lock said sliding glass window closed or in a partially open position.

2. The device according to claim 1 in which said resilient triangular block is tilted approximately 5 to 10 degrees whereby said jamming tip is close to the surface of the glass when installed.

3. The device according to claim 2 including an audible alarm and means for activating said audible alarm when said sliding window lock is installed and an attempt is made to force the window open.

4. The device according to claim 3 in which said means for activating said audible alarm comprises a switch mounted on said oblique surface for engagement by the frame of a sliding window whereby a force applied to said sliding window to open it when said sliding window lock is installed will close said switch activating said alarm.

5. The device according to claim 3 in which said means for activating said alarm comprises a motion sensing switch embedded in said resilient triangular block for sensing attempts to force a sliding window open.

6. The device according to claim 3 in which said means for activating said audible alarm comprises a pressure sensing switch means for sensing pressure applied to said oblique surface by a force applied to try to open said sliding window when said sliding window lock is installed.

7. The device according to claim 1 including an audible alarm and means for activating said audible alarm when said sliding window lock is installed and an attempt is made to force the window open.

8. The device according to claim 7 in which said means for activating said audible alarm comprises a switch mounted on said oblique surface for engagement by the frame of a sliding window whereby a force applied to said sliding window to open it when said sliding window lock is installed will close said switch activating said alarm.

9. The device according to claim 7 in which said means for activating said alarm comprises a motion sensing switch embedded in said resilient triangular block for sensing attempts to force a sliding window open.

10. The device according to claim 7 in which said means for activating said audible alarm comprises a pressure sensing switch means for sensing pressure applied to said oblique surface by a force applied to try to open said sliding window when said sliding window lock is installed.

* * * * *